US009724590B2

(12) United States Patent
Reinig

(10) Patent No.: US 9,724,590 B2
(45) Date of Patent: Aug. 8, 2017

(54) SNOW RIDER

(71) Applicant: Karl Reinig, Denver, CO (US)

(72) Inventor: Karl Reinig, Denver, CO (US)

( * ) Notice: Subject to any disclaimer, the term of this patent is extended or adjusted under 35 U.S.C. 154(b) by 0 days.

(21) Appl. No.: 14/865,053

(22) Filed: Sep. 25, 2015

(65) Prior Publication Data

US 2017/0087439 A1 Mar. 30, 2017

Related U.S. Application Data

(63) Continuation-in-part of application No. 13/843,534, filed on Mar. 15, 2013, now Pat. No. 9,174,663.

(51) Int. Cl.
*A63C 5/00* (2006.01)
*A63C 5/03* (2006.01)
*A63C 5/06* (2006.01)

(52) U.S. Cl.
CPC ..... *A63C 5/031* (2013.01); *A63C 5/06* (2013.01)

(58) Field of Classification Search
CPC .. A63C 5/031; A63C 5/02; A63C 5/06; A63C 5/065; A63C 5/033
See application file for complete search history.

(56) References Cited

U.S. PATENT DOCUMENTS 2,592,116 A * 4/1952 Caughrean ..... B62B 13/10 280/102
3,907,320 A * 9/1975 Charneck ..... A63C 5/16 280/818
4,627,636 A * 12/1986 Payraud ..... A63C 5/16 280/607
5,037,124 A * 8/1991 Quaggiotti ..... A63C 5/02 280/602
5,411,282 A * 5/1995 Shannon ..... A63C 5/031 280/14.24
5,558,354 A * 9/1996 Lion ..... A63C 5/16 280/607
5,865,446 A * 2/1999 Kobylenski ..... A63C 5/02 280/14.23
6,341,786 B1 * 1/2002 Kermis ..... A63C 5/031 280/14.22
7,040,634 B1 * 5/2006 Elkins, Jr. ..... A63C 5/031 280/14.25
8,118,319 B2 * 2/2012 Hsieh ..... A63C 17/0033 280/87.021
9,174,663 B2 * 11/2015 Reinig ..... B62B 13/12
9,592,434 B2 * 3/2017 Slagter ..... A63B 69/18
2002/0050693 A1 * 5/2002 Link ..... A63C 5/031 280/14.25

(Continued)

*Primary Examiner* — Erez Gurari
(74) *Attorney, Agent, or Firm* — Graziano IP Law LLC

(57) ABSTRACT

The Snow Rider provides two separate platforms, each equipped with a pair of truck mounted skis, interconnected via a centerline articulated spar. Each platform undergoes an angle change before articulating with the trucks. This angle change is referred to herein as the truck angle, which determines the degree to which the skis turn relative to the long axis of the Snow Rider for a given amount of rotation of the platform about the centerline. The trucks translate leaning by the rider into a redirection of the skis, which through the use of ski riser mechanisms between the platforms and skis, are simultaneously rotated about their long axis to get the skis up on edge and in contact with the snow.

10 Claims, 5 Drawing Sheets

(56) References Cited

U.S. PATENT DOCUMENTS

| | | | | |
|---|---|---|---|---|
| 2003/0155726 | A1* | 8/2003 | Braun | A63C 5/02 280/14.21 |
| 2006/0091623 | A1* | 5/2006 | Belt | A63C 5/031 280/15 |
| 2008/0185814 | A1* | 8/2008 | Riepler | A63C 5/02 280/601 |
| 2008/0246255 | A1* | 10/2008 | Hallsten | A63C 5/031 280/606 |
| 2014/0265178 | A1* | 9/2014 | Reinig | B62B 13/12 280/14.1 |

* cited by examiner

SNOW RIDER

CROSS-REFERENCE TO RELATED APPLICATIONS

This application is a continuation-in-part of the application titled "Snow Rider" filed on Mar. 15, 2013 as U.S. patent application Ser. No 13/843,534.

FIELD OF THE INVENTION

This invention relates to a Snow Rider that makes use of two pairs of parallel-oriented articulated skis that are interconnected by a two respective platforms on which the rider's bindings are attached. The front and back platforms are interconnected by an articulating element (spar) and also connected to respective front and rear ones of the two pairs of skis via trucks that translate leaning by the rider into a redirection of the Snow Rider and by simultaneously operable ski riser mechanisms that get the skis up on edge and in contact with the snow as the skis are turned.

BACKGROUND OF THE INVENTION

There are several types of sporting equipment that enable a user to glide over snow, make turns, and control their speed. The primary products in this category are skis and snowboards, both of which are equipped with bindings that receive and secure boots that are worn by the user.

Skis orient the user to face in the direction of travel, with one foot on each ski, so the skis are oriented in a substantially parallel relationship when the user is in motion. A ski is typically a narrow strip of wood, plastic, metal, or a combination thereof, worn underfoot to enable the wearer to glide over snow. Substantially longer than wide and characteristically employed in pairs, the skis are attached to boots with bindings, either with a free, lockable, or permanently secured heel. Examining the ski from front to back along the direction of travel, the front of the ski (typically pointed or rounded) is the "tip," the middle is the "waist," and the rear (typically flat) is the "tail." All skis have four basic measures that define their basic performance: length, width, side-cut, and camber. Skis also differ in more minor ways to address certain niche roles. For instance, mogul skis are much softer to absorb shocks, and powder skis are much wider to provide more float.

In contrast, snowboards are a single board that is usually as wide as the length of the wearer's foot. Snowboards are further differentiated from skis by the stance of the user. In skiing, the user stands with feet in-line with the direction of travel (parallel to long axis of board), whereas in snowboarding, users stand with their feet transverse to the length dimension of the snowboard. Snowboards generally require bindings and special boots that help secure both feet of a snowboarder, who uenerally rides in an upright position. The bindings are separate components from the snowboard deck and are very important parts of the total snowboard interface. The bindings' main function is to hold the rider's boot in place tightly to transfer their energy to the board. Most bindings are attached to the board with three or four screws that are placed in the center of the binding. There are two types of stance-direction used by snowboarders. A "regular" stance places the rider's left foot at the front of the snowboard, while the opposite stance direction places the rider's right foot at the front, as in skateboarding. Regular is the most common stance used by riders.

Neither snowboards nor skis turn much by having the rider simply lean. To initiate a turn on either of these products, the rider must push the back ends of the ski or snowboard around. With a snowboard, the learning process generally takes multiple outings involving significant collisions with the ground before the rider can take on even modest green slopes. Skiers generally rely on the snowplow position where the skis are pointed in a "V" shape in front of the skier to slow their forward motion and to initiate turns early on. Again, days are required before even modest hills can be conquered by a novice skier and, after years, only the best riders can truly ski the moguls. Most simply scrape off the top of the moguls as they slide sideways in an attempt to remain in control of their motion. Thus, neither of these technologies is user friendly and both require a significant investment in time and professionally administered lessons for the user to develop a modest level of competence.

In an analogous field, water skis enable a rider who is towed by a boat to execute turns as they travel over the surface of the water. While the tow rope limits the range of motion of the rider, the basic nature of the water skis is similar to those used in snow skiing.

BRIEF SUMMARY OF THE INVENTION

The Snow Rider provides a rider with an apparatus that is stable, simple to use, and provides a significant amount of control for the rider. Two separate platforms, each equipped with a pair of truck mounted skis, are interconnected via a centerline articulated spar. Each platform undergoes an angle change before articulating with the trucks. This angle change is referred to herein as the truck angle, which determines the degree to which the skis turn relative to the long axis of the Snow Rider for a given amount of rotation of the platform about the centerline. The trucks translate leaning by the rider into a redirection of the skis, which through the use of ski riser mechanisms between the platforms and skis, are simultaneously rotated about their long axis to get the skis up on edge and in contact with the snow. The rider can either face the direction of motion as with skis or face perpendicular to the direction of motion as with a snowboard. A seat could also replace the bindings, thereby allowing the rider to sit instead of standing.

It is important to note that if you just put skis on trucks, when you lean, the skis turn; however, they will remain flat on the snow. The result is that the rider slides sideways down the hill but does not "carve" a turn. The Snow Rider mechanism uses ski riser mechanisms to get the skis up on edge as they are turned so the skis gain traction from the snow to execute the turn in a smooth and controlled manner. The simultaneous turning of the skis and getting them up on edge are initiated and controlled by the amount the rider leans to either side. In one implementation, the trucks are mounted in opposite directions on each end of the platform on which the rider is standing. Thus, when the rider leans to the right, the front skis turn to point to the right, while the back skis turn to point to the left. With this symmetry, the rider can go either forward or backward with the same control, much the same way they can go forward or backward on a skateboard. This sort of symmetry allows for doing 180-degree turns with a high degree of control.

In addition, the platforms that support the rider's boots may be rotated relative to one another. This relative motion includes rotation about the long axis of the Snow Rider centerline spar to allow the rider to vary the relative degree to which the front and back pairs of skis are turned and rotated, providing a simplified method of producing a sideways slide.

DETAILED DESCRIPTION OF THE INVENTION

Basic Architecture

The following description of a preferred embodiment of the Snow Rider illustrates the functional elements that are used to implement the Snow Rider, which enables a rider to travel down an inclined slope, such as over snow on a ski slope, propelled by gravity, or over a substantially flat surface, such as over water, towed by a boat. The details disclosed herein are not intended to limit the scope of the invention, which is defined in the appended claims, but simply to provide a teaching of the functional elements to one of ordinary skill in the art. In order to accomplish this goal, the following description is directed to a Snow Rider, which is used to enable the rider to travel down an inclined snow covered slope, with the disclosed apparatus being bi-directional in nature, akin to a snowboard, so any designation of "front" or "back" is arbitrary in nature, as is the location and direction of the bindings shown. The rider can be positioned in a number of places and orientations, and the specifics of such are left up to the preferences of the rider.

Details of the Snow Rider

Figure 1:
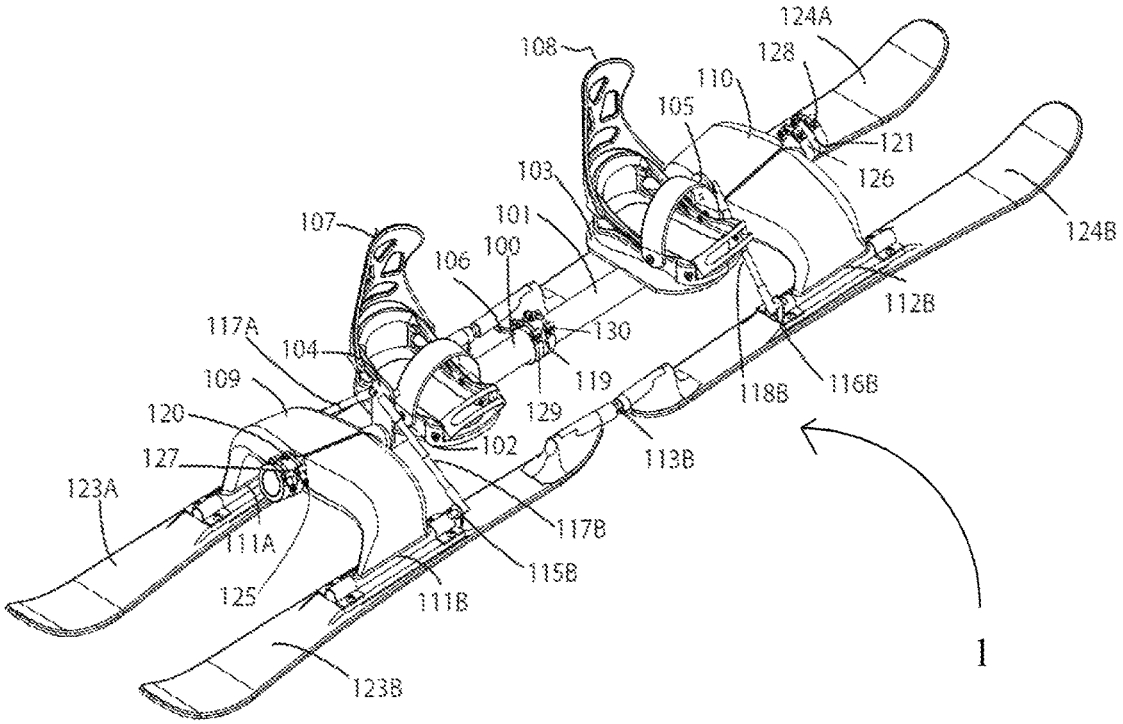
FIG. 1 illustrates an isometric view of the snow rider in its neutral configuration.
Figure 2:
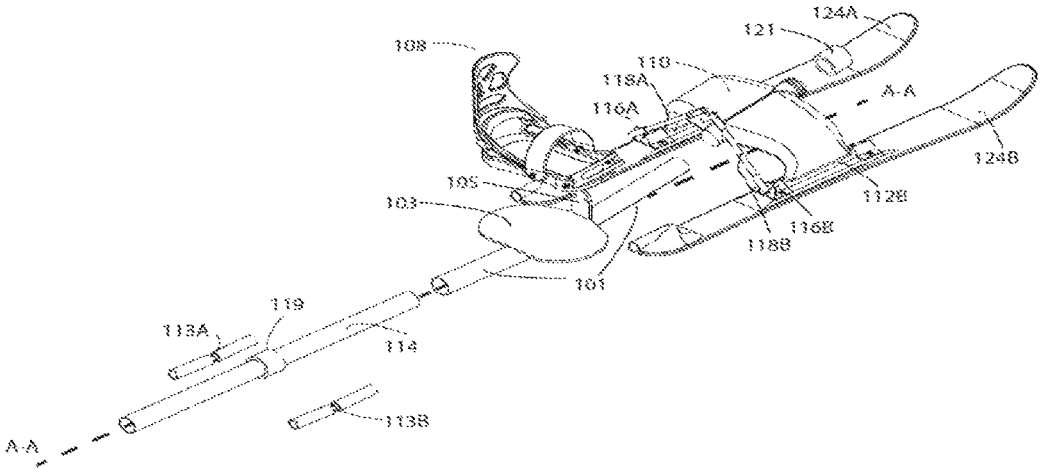
FIG. 2 illustrates an isometric exploded view of one side of the snow rider, exposing the center spar, which is generally out of view inside of the two main spar sections.
Figure 3:
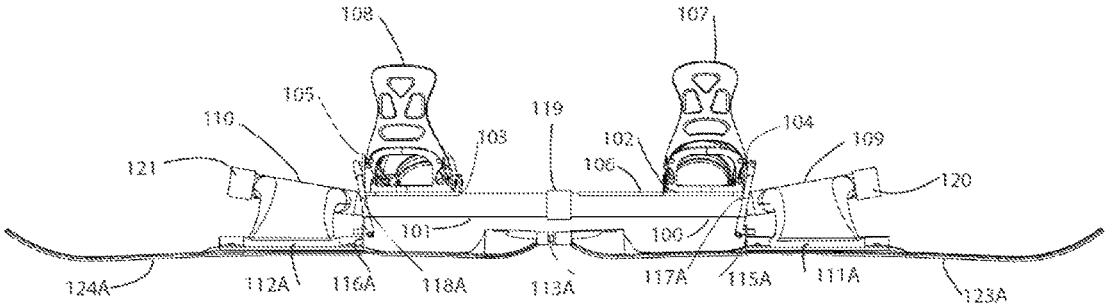
FIG. 3 illustrates a side view of the snow rider in its neutral configuration.

FIG. 1 illustrates an isometric view of the Snow Rider 1 in its neutral configuration. FIG. 2 illustrates an isometric exploded view of one side of the Snow Rider 1, exposing the center spar 114, which is generally out of view inside of the two main spar sections 100, 101. FIG. 2 also shows a line segment A-A from an axis that is concentric with the centerline spar 114, and both proximal sections of the main spars 100, 101. FIG. 3 illustrates a side view of the Snow Rider 1 in its neutral configuration.

Skis

Two pairs of parallel-oriented articulated skis 123A, 123B, and 124A, 124B provide a sliding surface between the Snow Rider 1 and the snow. The parallel-oriented pairs of skis 123A, 123B, and 124A, 124B are attached to trucks 109, 110, which, in turn support an interconnected one of the platforms 102, 103 on which the rider's bindings 107, 108, respectively, are attached.

Main Spar

Figure 6:
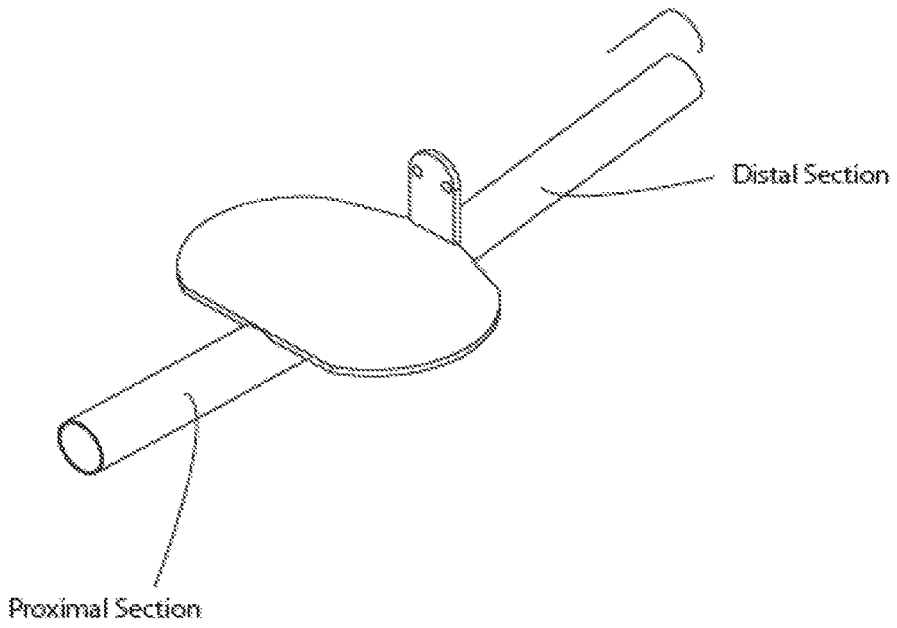
FIG. 6 illustrates additional descriptive nomenclature for the main spar.
Figure 7:
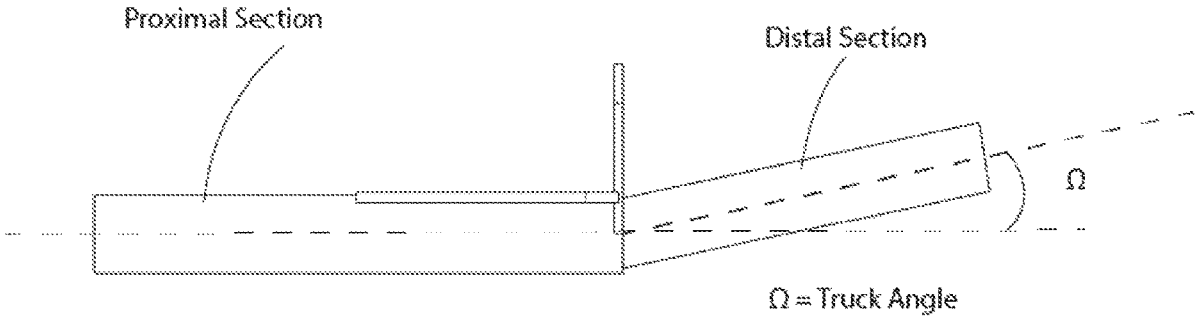
FIG. 7 illustrates a side view of main spar demonstrating angle between the proximal and distal sections.

The main spars (FIG. 1) are circular tubes 100, 101 that include proximal sections that support the platforms 102, 103 and distal sections that pass through receiving cylinders in the trucks 109, 110. Proximal and distal portions of the main spar are labeled in FIG. 6. The angle between the proximal and distal sections (FIG. 7) of each main spar defines the truck angle for its associated truck.

Center Spar

The center spar 114 is a cylindrical tube that is centered inside the proximal sections of the two main spars 100, 101. Its outside diameter is generally just enough smaller than the inside diameter of at least one of the proximal main spar sections that support the spar platforms 102, 103, to allow the proximal sections of the main spars to rotate independently about the axis A-A.

Platform

Together, the two platforms 102, 103 support the weight of the rider. Each platform 102, 103 is rigidly attached to its respective proximal section of the main spar 100, 101 which is rigidly connected to its respective distal section of the main spar, which is rotatable in each of the respective trucks 109, 110.

Main Spar Riser

Figure 8:
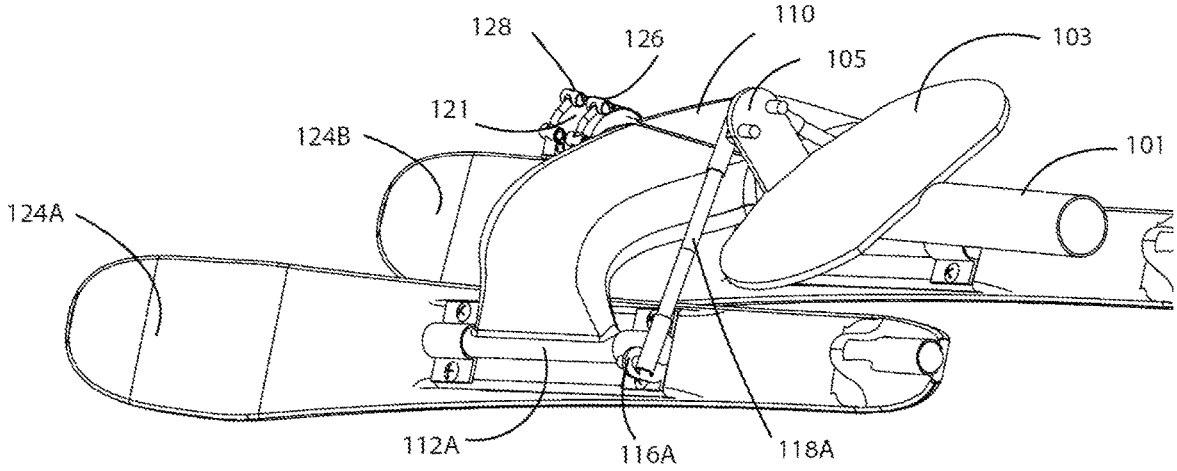
FIG. 8 illustrates a view focused on the relationship between a main spar riser, a ski riser, and a main spar-riser-to-ski-riser connector.

The mechanisms for getting the skis on edge as a result of rotating either of the main spar platforms with respect to the main axis A-A of the Snow Rider 1 include main spar risers 104, 105, ski risers 115A, 115B and 116A, 116B, and main-spar-riser-to-ski-riser connectors 117A, 117B and 118A, 118B as described herein and as shown in detail in FIG. 8. The main spar risers 104, 105 provide an offset to the main spars 100, 101 and are connected to the respective ski risers 115A, 115B and 116A, 116B by the main-spar-riser-to-ski-riser connectors 117A, 117B and 118A, 118B. Rotation of the platforms 102, 103 along the main axis A-A of the Snow Rider 1 causes the main spar-riser-to-ski-riser connectors 117A, 117B and 118A, 118B to either push or pull the ski risers 115A, 115B and 116A, 116B, which in turn, rotate the skis 123A, 123B, and 124A, 124B about their respective long axis. Varying the length of the main spar risers 104, 105 varies the magnitude of the rotation of the skis 123A, 123B, and 124A, 124B relative to the rotation of the platforms 102, 103.

Main-Spar-Riser-to-Ski-Riser Connector

The main-spar-riser-to-ski-riser connectors 117A, 117B and 118A, 118B transfer force from the main spar risers 104, 105 to their respective ski risers 115A, 115B and 116A, 116B. Each of the main-spar-riser-to-ski-riser connectors 117A, 117B and 118A, 118B utilizes joints at each end to allow for the relative twisting between the two respective ski risers 115A, 115B and 116A, 116B, while maintaining essentially the same distance between the connection points of the associated main spar risers 104, 105 and ski risers 115A, 115B and 116A, 116B. Because the main spar risers 104, 105 are located away from the center of rotation of their supporting main spars 100, 101 and the ski risers 115A, 115B, 116A, 116B are located away from the center of rotation of the truck to ski bearings 111A, 111B and 112A, 112B, maintaining the same distance between the main spar risers 104, 105 and their respective ski risers 115A, 115B and 116A, 116B, produces a torsion force on the skis about the associated truck to ski bearings. In FIG. 8, the platform 103 has been rotated about the axis A-A. The main-spar-to-ski-riser-connector 118A maintains a near constant distance between its connection to the main spar riser 105 and the ski riser 116A. The perpendicular distance between the connection to the ski riser 116A and the truck to ski bearing 112A causes the motion of the ski riser 116A connection to rotate the ski 124A about the axis of the truck to ski bearing 112A. The result is that the ski 124A gets on edge relative to the snow. Depending on which way the platform 103 is rotated, the main-spar-riser-to-ski-riser is either pushing or pulling on its associated ski riser, causing the ski to either get on its inside (when the main-spar-riser-to-ski-riser is pulling) or outside (when the main-spar-riser-to-ski-riser is pushing) edge.

Ski Riser

The ski risers 115A, 115B and 116A, 116B provide an offset to the skis 123A, 123B, and 124A, 124B and are connected to the main spar-risers 104, 105 by the main-spar-riser-to-ski-riser connectors 117A, 117B, and 118A, 118B. Varying the length of the ski risers 115A, 115B, and 116A, 116B, in particular their perpendicular distance from their associated truck to ski bearings varies the magnitude of the rotation of the skis 123A, 123B, and 124A, 124B relative to the rotation of the platforms 102, 103.

Non-Bound Boot Support

There are multiple instances in which the rider will want to have one foot attached to the Snow Rider 1 by the boot binding 108 while the other foot remains detached from the Snow Rider 1. One such instance is when the rider is boarding a chair lift. In this case, having a free foot allows the rider to propel the Snow Rider 1. This will generally result in the rider having one foot detached from the Snow Rider 1 when disembarking from the chair lift. The non-bound boot support 106 provides a platform for the foot that is not attached to a Snow Rider 1 by the boot binding 107. The foot that is supported by the non-bound boot support 106 can still apply torsion to the main spar 100 by shifting weight toward the toe or heel, depending on the desired direction of the torsion. This allows the rider to maintain the control that comes from varying the relative rotations of the two platforms 102, 103, when only one foot is bound to the Snow Rider 1. In addition, the non-bound boot support 106 can be constructed in such a way that it can also produce an efficient method for scraping snow from the bottom of a boot.

Boot Binding

The boot bindings 107, 108 attach the boots of the rider to each of the two platforms 102, 103.

Truck

The trucks 109, 110 articulate with the distal sections of the main spars 100, 101 thereby connecting the main spars with the skis 123A, 123B, and 124A, 124B. Because of the angle between the proximal and distal sections of the main spars 100, 101, and the rigid attachment of the proximal section of the main spars to their associated platforms 102, 103, rotation of the platforms 102, 103 causes their associated trucks 109, 110 to rotate about an axis that is generally perpendicular to the snow. This in turn causes the associated skis 123A, 123B, and 124A, 124B to rotate around an axis that is uenerally perpendicular to the snow. The amount of rotation is directly proportional to the angle between the proximal and distal sections of the main spars 100, 101.

Truck to Ski Bearing

The truck to ski bearings 111A, 111B, 112A, 112B, as shown in FIG. 8, allow the skis 123A, 123B, 124A, 124B to rotate about their long axes, while constraining all other motion of the skis, relative to the associated truck 109, 110. The articulation is such that the skis 123A, 123B, and 124A, 124B may rotate about the long axis of the truck bearing 111A, 111B and 112A, 112B. While the long axis of the truck bearing 111A, 111B and 112A, 112E generally lines up with the long axis of its associated ski 123A, 123B, and 124A, 124B, variances to this angle may be used to shift the distribution of the contact force of the associated skis 123A, 123B, and 124A, 124B with the snow.

Ski-to-Ski Connector

The ski-to-ski connectors 113A, 113B each consist of two cylinders connected by a flexible material or joint. The flexible material or joint allows the angle between the two cylinders to change, while maintaining essentially the same distance between the associated ends of the cylinders. Each cylinder then slides inside corresponding cylindrical openings in the proximal portions of the corresponding skis. The result forces the two skis that are in contact with the connector to essentially point toward one another, while allowing the distance between them to vary. The ski-to-ski connectors provide multiple benefits including:

- Allowing the distance between the proximal ends of skis 123A, 123B and the proximal ends of skis 124A, 124B respectively to vary, which occurs any time either platform is rotated, relative to axis A-A of the Snow Rider 1.
- Having the back of the front (relative to the direction of travel) ski 123A, 123B, whose curved front end generally pulls the ski 123A, 123B further into the direction of the carve, pull the front of the back ski 124A, 124B, which has diminished or no associated force from the snow trying to pull it in the correct direction for making the turn.
- Providing a support for sliding on top of thin rails when the Snow Rider 1 is generally perpendicular to said rails.

Main-Spar-to-Main-Spar Elastic Connector

The main-spar-to-main-spar elastic connector 119 is a flexible cylindrical structure that connects the proximal ends of the proximal sections of the two main spars 100, 101 in such a way that they can rotate relative to each other about axis A-A, while being constrained to not translate relative to each other along axis A-A. This is accomplished by squeezing each end of the of the main-spar-to-spar elastic connector 119 against the two proximal ends of the main spars 100, 101, using clamps or similar devices 129, 130 (FIGS. 1 and 8). Because the main-spar-to-spar elastic connector 119 is elastic, as the two main spars 100, 101 attempt to rotate relative to one another about axis A-A, the main-spar-to-main-spar elastic connector 119 twists along its length. The twisting of the elastic material creates internal stress, which is transferred to the proximal ends of the main spars 100, 101, resulting in a restorative force between the main spars 100, 101. The restorative force increases as the angle between the two platforms 102, 103 increases. Thus, if the rider applies a rotational force to the platform 102, rotating the attached main spar support 100, the main-spar-to-main-spar elastic connector 119 applies torsion to the main spar support 101, which transfers the torsion to the platform 103 that tends to rotate the platform l03 in the same direction. However, the force may be overcome, allowing the rider to vary the amount and direction of rotation of each of the two platforms 102, 103 independently.

Truck-to-Main-Spar Elastic Connector

The-truck-to-main-spar-elastic connectors 120, 121 connect the truck 109, 110 to the distal sections of the main spars 100, 101 in such a way that they can rotate relative to each other along the long axis of the distal section of the main spar 100, 101, while being constrained to not translate relative to each other along that same axis. The truck-to-main-spar elastic connectors 120, 121 work in a manner similar to the main-spar-to-main-spar connector 119, the main difference being that the clamps 125, 126 and 127, 128 (FIGS. 1 and 8) squeeze the ends of the elastic cylinder against the ends of the distal sections of the main spars 100, 101 and their corresponding cylindrical sections of the associated trucks 100, 110. As with the main-spar-to-main-spar connector 119, the elastic material of the truck-to-main-spar elastic connectors 120, 121 develops internal stress when the main spars 100, 101 are rotated relative to the corresponding receiving cylinder of the associated truck 109, 110. The internal stress is applied across the trucks 109, 110 and main spars 100, 101, causing a restorative force that increases as the distal section of the main spars 100, 101 passing through the trucks 109, 110 rotate relative to the truck 109, 110. This restorative force has multiple advantages, including creating a torsion that tends to right the rider, which is particularly noticeable at slow speeds where the centripetal force associated with carving is minimized.

Overview Description

FIG. 1 illustrates an isometric view of the Snow Rider 1 in its neutral configuration. FIG. 2 illustrates an isometric exploded view of one side of the Snow Rider 1, exposing the center spar 114, which is generally out of view inside of the two main spar sections 100, 101. FIG. 2 also shows a line segment A-A from an axis that is concentric with the centerline spar 114, and both proximal sections of the main spars 100, 101. FIG. 3 illustrates a side view of the Snow Rider 1 in its neutral configuration.

Snow Rider 1 consists of two pairs of skis, each of which consist of a parallel-oriented pair of skis 123A, 123B, and 124A, 124B that are attached to trucks 109, 110, which are in turn interconnected by respective platforms 102, 103 on which the rider's bindings 107, 108, respectively, are attached. Since the location and type of bindings can vary widely, a simple illustration of bindings is included to simply show their presence and typical location. Each truck 109, 110 articulates with two skis 123A, 123B, and 124A, 124B, respectively, and the articulation is such that the skis 123A, 123B, and 124A, 124B can rotate about axis A-A, while remaining essentially parallel to each other. Structures, referred to as main-spar-riser-to-ski-riser connectors, articulate with both the main spar risers, which are rigidly connected to their associated platform segments 102, 103, and the ski-risers 104, 105, which are rigidly connected to their associated skis 123A, 123B, and 124A, 124B. This is done in such a way that rotating the platform segments 102, 103 about axis A-A. causes the associated skis 123A, 123B, and 124A, 124B, respectively to rotate about their articulation with the truck to ski bearings 111A, 111B, and 112A, 112B, which are rigidly attached to their associated truck 109, 110.

Where the ends of each pair of skis 123A, 123B, and 124A, 124B, respectively are juxtaposed to each other, the proximal ends of the skis, the skis are rounded in such a way that they run smoothly over the snow, whether going forward or backward. The rounding appears similar to the front of a mono-hull boat, minimizing the carving of the ski when traveling in what is referred to as the reverse direction for that ski. In addition, where the ends of the skis are juxtaposed to each other, ski-to-ski connectors 113A, 113B articulate between the two skis. The structures keep the skis relatively in line, while allowing them to rotate independently about their long axis and vary their distance.

Executing a Turn

Figure 4:
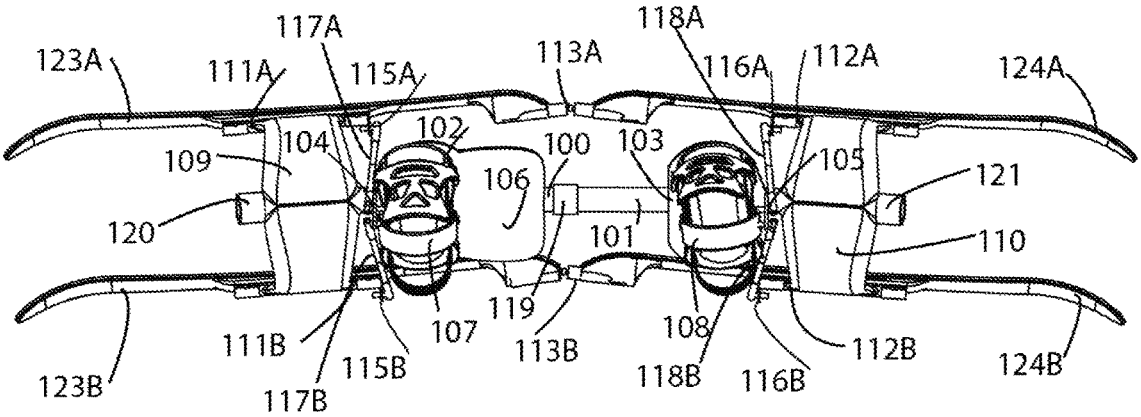
FIG. 4 illustrates an overhead view of the Snow Rider with both platforms rotated about the long axis of the Snow Rider, creating a carved turn.

FIG. 4 illustrates a top view of skis 123A, 123B, and 124A, 124B and helps demonstrate the operation of the Snow Rider 1. When both main spar platforms have been rotated in the same direction about the axis A-A, as shown in FIG. 4, the change in angle between the proximal sections of the main spars 100, 101 and the distal sections of the main spars 100, 101, causes the trucks to rotate about an axis that is essentially perpendicular to the snow. The result, as shown in FIG. 4, is that the pair of skis 123A and 124A and the pair of skis 123B and 124B each create a piecewise linear approximation to a circular segment. At the same time, the main-spar-riser-to-ski-riser connectors 117A, 117B, and 118A, 118B in concert with the main spar risers 104, 105 and ski risers 115A, 115B, and 116A, 116B, force the skis to rotate along their long axis. The result is skis that are on edge and forming an approximation to a circular segment. When the Snow Rider 1 is moving, this orientation forces the Snow Rider to turn into the direction pointed at by the leading skis. The radius of the approximated circular segment decreases directly with increasing rotation of the platforms about the axis A-A.

Executing a Slide

Figure 5:
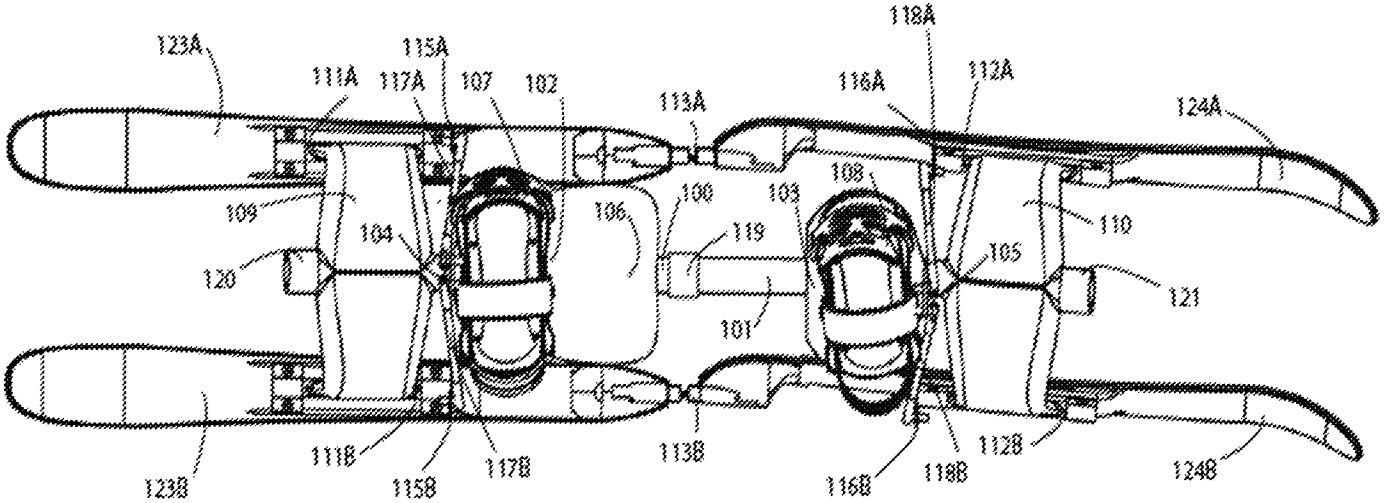
FIG. 5 illustrates an overhead view of the Snow Rider with one platform rotated about the long axis of the Snow Rider, while the other platform remains in the neutral orientation.

FIG. 5 illustrates a top view of the skis 123A, 123B, and 124A, 124B, of the Snow Rider 1 when a rider has rotated only one of the platforms 103, about the axis A-A. The result is that the skis 124A, 124B have turned and gotten on edge, the same as they did for the turn described above. However, the skis 123A, 123B associated with the un-rotated platform lay flat on the snow and have not turned. If the skis 124A, 124B are leading the Snow Rider 1 in the direction of travel, they will produce a force that both turns and decelerates the Snow Rider 1. The skis 123A, 123B, however, will simply slide. The resulting difference between the interaction of the two sets of skis 123A, 123B and 124A, 124B with the snow, creates a rotation of the Snow Rider 1 about an axis essentially perpendicular to the snow. If relative rotations of the two platforms are not changed, the Snow Rider 1 will settle with the skis 123A, 123B leading the device in the direction of travel. Any time during the rotation, the platform 102, can be rotated in the same direction as the rotation of the platform 103. If this is done while axis A-A is perpendicular to the direction of travel, the digging in of the edges of all four skis will cause the Snow Rider 1 to decelerate in a quick and controlled manner Summary The Snow Rider 1 provides a rider with a platform that is stable, simple to use, and provides a significant amount of control for the rider. The Snow Rider 1 makes use of two pairs of parallel-oriented articulated skis that are interconnected by platforms on which the rider's bindings are attached. The platforms are connected to a pair of articulated skis via trucks that translate leaning by the rider into a redirection of the Snow Rider 1 by getting the skis up on edge and in contact with the snow as they are turned.

What is claimed:

1. A snow rider system for enabling a rider to create turns by shifting their weight such that the supporting platforms cause the surfaces that are in contact with the snow to synchronously turn and rotate, comprising:

first and second platforms, interconnected in a linear arrangement by an articulated spar, and having a platform center line axis extending along a length of the first platform, the articulated spar and the second platform, from a first end to a second end, for supporting a rider;

first and a second pairs of skis, wherein each of the pairs of skis comprise first and second skis, each ski of each pair of skis being on opposite sides of and oriented substantially parallel to the platform center line axis;

first and second trucks, connected to the first and second pairs of skis, respectively, for connecting the first and second pairs of skis to the first and second platforms; and wherein the first and second platforms are independently rotatable relative to one another about the platform center line axis, in response to the rider shifting their weight to either side of the platform center line axis as the surface rider moves either down an inclined surface or towed across a substantially flat surface, to provide a variety of combinations of relative orientations between the parallel pairs of skis, including both point in the same direction, one pointing in one direction, while the other points in the opposite direction, one pointing straight ahead, while the other points in either direction, and all combinations between.

2. The snow rider of claim 1 wherein the articulated spar comprises:

first and second spars, each composed of a cylinder having first and second ends, with one cylinder at an angle to the other and sharing the same center line axis; and a center spar, connected to the second end of the first spar and the first end of the second spar to interconnect the first and second spars along the center line axis, while allowing them to rotate about the center line axis.

3. The surface rider of claim 2 wherein the center spar comprises:

a flexible connection between the first and second spars, to create an increasing restorative torsion that is proportional to the relative angle between the first and second spars to bring the first and second platforms in a linear relationship along the platform center line axis.

4. The snow rider of claim 3 wherein:

the first truck is rotatably connected to the first end of the first spar to enable the first truck to rotate about the center line axis as the rider shifts their weight on the first platform while providing a restorative torsion to the truck to maintain the first set of skis in contact with the snow; and the second truck is rotatably connected to the second end of the second spar to enable the second truck to rotate about the center line axis as the rider shifts their weight on the second platform while providing a restorative torsion to the truck to maintain the second set of skis in contact with the snow.

5. The snow rider of claim 4 wherein the first and second spars are connected by the center spar which maintains the second end of the first spar at an angle with respect to the first end of the second spar such that the first spar and second spar are responsive to redirection of the first pair of skis, to redirect the second pair of skis in a direction that is opposite to the direction of the first pair of skis thereby to form a piecewise linear arc.

6. The snow rider of claim 1 wherein each of the first and second trucks have bearings that connect to the associated skis and each articulate with the associated ski to enable the ski to rotate about a line sement running the length of the bearing and constraining any other motion with respect to the truck.

7. The snow rider of claim 1 further comprising:

first and second ski riser mechanisms connected to and interconnecting the first and second skis with the first and second platforms, respectively to translate leaning by the rider into a redirection of the skis.

8. The snow rider of claim 1 further comprising:

ski to ski connectors that articulate with the proximal ends of each pair of skis that are essentially in line to allowing the distance between the two pairs of skis to vary while keeping them essentially in line.

9. The snow rider of claim 1 further comprising:

first and second bindings, attached to the first and second platforms, respectively, for securing the first and second platforms to the feet of the rider such that the rider's feet are substantially parallel and perpendicular to the center line axis.

10. The snow rider of claim 1 further comprising:

binding free platform connected to one of the platforms to provide support for one foot of the rider enabling the rider to control the torsion applied to the binding free platform when their boot is not secured to the binding free platform.

* * * * *